United States Patent [19]

Coant et al.

[11] 4,175,046

[45] Nov. 20, 1979

[54] SYNTHETIC LUBRICANT

[75] Inventors: Pierre M. Coant, Woodbury; George W. Munns, Jr., West Deptford, Township, County of Gloucester, both of N.J.

[73] Assignee: Mobil Oil Corporation, New York, N.Y.

[21] Appl. No.: 944,519

[22] Filed: Sep. 20, 1978

[51] Int. Cl.[2] ..... C10M 1/26; C10M 3/20

[52] U.S. Cl. ..... 252/56 S; 585/3; 585/10; 585/18

[58] Field of Search ..... 252/56 S, 59

[56] References Cited

U.S. PATENT DOCUMENTS

| | | | |
|---|---|---|---|
| 2,788,326 | 4/1957 | Bondi et al. | 252/56 D |
| 3,235,498 | 2/1966 | Waldmann | 252/33.4 |
| 3,382,291 | 5/1966 | Brennan | 260/683.15 |
| 3,694,382 | 9/1972 | Kleiman et al. | 252/56 S |
| 3,725,498 | 4/1973 | Brennan | 260/683.15 |
| 3,763,244 | 10/1973 | Shubkin | 252/56 S |
| 3,780,128 | 12/1973 | Shubkin | 252/59 |
| 3,843,535 | 10/1974 | Denis | 252/56 S |
| 3,860,522 | 1/1975 | Fischer et al. | 252/56 S |

*Primary Examiner*—Irving Vaughn

*Attorney, Agent, or Firm*—Charles A. Huggett; Raymond W. Barclay; Claude E. Setliff

[57] ABSTRACT

A synthetic lubricating composition is provided comprising a major proportion of a base oil and a minor proportion of a plurality of additives, added for the purpose of substantially improving properties of such composition other than viscosity index. The base oil comprises (1) a mixture of at least two fatty acid esters of specified characteristics with regard to viscosity and (2) a hydrogenated oligomer of an alpha olefin of 6 to 12 carbon atoms. The resulting blend of base oil and additives has a viscosity index which differs from that of the base oil by no more than 20.

11 Claims, No Drawings

SYNTHETIC LUBRICANT

BACKGROUND OF THE INVENTION

1. Field of the Invention

This invention relates to a synthetic lubricating composition made up of a mixture of esters of particularly specified characteristics with regard to viscosity and a hydrogenated alpha olefin oligomer and to the lubrication of marine engines therewith.

2. Description of the Prior Art

The lubrication of marine engines, both of the spark ignition and diesel type, involves many unique problems. For the most part, such engines are designed for operation with mineral oils as lubricants. The metallurgy and other design features are selected for compatibility with oil fractions obtained by distilling from petroleum and finishing by solvent extraction, dewaxing and stabilizing by clay percolation or catalytic hydrogenation. For example, seals such as those at oil filter connections are fabricated of rubber formulation which will retain desired properties in contact with mineral oil fractions. These and other constraints on acceptability in service severely restrict freedom of choice in formulation of engine oils.

It has been known for some years that certain synthetic liquids afford properties that are superior to those of mineral oils. A considerable number of viscous esters have been proposed as lubricants, and some have attained commercial importance for such specialized purposes as lubrication of aircraft jet engines, hydraulic fluids and the like. These esters include: di-iso-nonyl dodecanedicate, nonanoic acid ester of trimethylolpropane, di-iso-tridecyl adipate, and the like.

Another class of known synthetic lubricants includes hydrogenated oligomers of 6–12 carbon atom alpha olefins as described in U.S. Pat. Nos. 3,382,291, 3,149,178 and 3,725,498. Of this group, particular preference is accorded hydrogenated oligomers of decene-1, octene-1 and mixtures thereof. The preferred molecular weight is the decene-1 polymer in which the trimer usually predominates. However, mixtures of octene-1 and decene-1 polymers also provide acceptable performance. Typical properties of a hydrogenated alpha decene oligomer and a mixed hydrogenated alpha decene/octene oligomer are shown in Table 1.

TABLE 1

| | Alpha Decene Oligomer | Alpha Decene/Octene (85/15 Wt. %) Oligomer |
|---|---|---|
| API Gravity | 39.4 | 39.8 |
| Kinematic Viscosity | | |
| at 210° F. cSt. | 5.7 | 5.8 |
| at 100° F. cSt. | 30 | 29 |
| at −40° F. cSt. | 7,000 | 6,800 |
| Viscosity Index | 145 | 135 |
| Pour Point, °F. | −65 | −80 |
| Flash Point, °F. | 450 | 440 |
| Dimer Content, % | 0.35 | 0.30 |

Seal materials suited to these synthetic oils are available, but as previously noted, engine manufacturers must design their product for adaptability to mineral oils. As a result, the ester lubricants cause undue swelling of seals now used in automotive engines. The hydrogenated oligomers shrink such seals and permit leakage.

Blends of certain esters and oligomers have been marketed as engine oils, which blends behave in the same manner as mineral oils with respect to seals. These have been fully formulated oils including additives to impart antioxidant, antirust, dispersant and detergent properties as well as viscosity index (V.I.) improvement.

While they do not teach or suggest the lubricating oil blends of this invention, U.S. Pat. Nos. 3,763,244, 3,481,873, 3,843,535 and 3,860,522 are of interest. Other patents of interest are U.S. Pat. Nos. 3,694,382 and 4,010,106.

SUMMARY OF THE INVENTION

In accordance with the invention described herein a synthetic lubricant has been provided that is especially suitable for use in marine and industrial diesel engines. The lubricant comprises a major proportion of a blend of (1) a synthetic hydrocarbon lubricating oil, which is a hydrogenated oligomer of an alpha olefin having 6 to 12 carbon atoms and (2) a mixture of at least two synthetic ester lubricating oils and a portion of a mixture of additives to enhance the properties of such lubricant.

DESCRIPTION OF SPECIFIC EMBODIMENTS

As has already been mentioned, the engine oil of the invention is a blend of viscous esters and viscous oligomer plus a conventional package of additives without the usual V.I. improver.

The separate components of the base oil are chosen to satisfy certain minimum criteria. They should have flash points (ASTM No. D-92) not lower than about 400° F. Flash point of the oligomer is preferably at least 425° F.; that of the ester at least 425° F.

In the specified embodiments discussed below, the viscosity of the base oil blend is preferably in conformity with SAE 10 W and 30 or SAE 15 W and SAE 40 specifications.

The blends of oils per se of this invention contain from about 40 to about 60% by weight of the ester mixture and from about 60 to about 40% by weight of the synthetic hydrocarbon oil. The additive package constitutes from about 10 to about 30% by weight of the oil blend.

It has been found necessary to this invntion that the V.I. of the finished oil (with additives) be approximately the same as that of the base oil of ester and oligomer. Some of the additives used for other purposes can effect modest V.I. changes but the V.I. of the finished oil should not differ from that of the base oil of ester and oligomer by more than about 20.

Kinematic viscosity, as such term is utilized herein, was determined by ASTM D 445. Briefly, this method involves measurement of the time for a volume of liquid to flow under gravity through a calibrated capillary viscometer. Kinematic viscosity is a measure of the resistive flow of a liquid under gravity, the pressure head being proportional to the density of the fluid for gravity flow under a gravity hydrostatic head. The pressure head of a liquid is proportional to its density. For any particular viscometer the time of flow of a fixed volume of fluid is directly proportional to its kinematic viscosity. The kinematic viscosity at 210° F. of the mixed ester components of the present synthetic lubricant composition is at least about 3 centistokes and is generally less than about 50 centisokes. Preferably, such kinematic viscosity is greater than 20 and less than about 30 centistokes. The viscosity index of the ester combination is at least 125.

The ester blend may be prepared from esters made by reacting a monocarboxylic acid containing from 6 to 18 carbon atoms, preferably 8 to 10 carbon atoms, or mixtures thereof, with a polyhydroxy-containing aliphatic hydrocarbon, where the hydrocarbon portion contains 4 to 8 carbon atoms, preferably to 6 carbon atoms and from 2 to 4 hydroxyls. Preferably, we use a trimethylolalkane, the alkane having 1 to 5 carbon atoms. One of the esters in the blend is made with an acid mixture containing from about 30% to about 50% by weight of a polymer of linoleic acid, i.e. the dimer or trimer thereof or mixtures of such dimers and trimers. The methods for producing the esters are well known. In general, such methods involve merely mixing acid and alcohol and heating under conditions to remove water.

Representatives of the esters that are useful in the practice of the invention are:

1. Nonanoic acid ester of trimethylolpropane (TMP)
2. Heptanoic acid ester of a mixture of TMP and pentaerythritol Others include:

3. Octanoic/decanoic acid ester of TMP
4. Octanoic/decanoic/linoleic acid dimer and/or trimer ester of TMP
5. Heptanoic acid ester of TMP In the preparation of the blends of this invention, we prefer to use two different esters, the proportions thereof ranging from about 20 to about 30% by weight of either such that the total of the esters in the blend will range from about 40 to about 60% by weight.

The additive package is made up of additional agents which will impart needed properties to the finished oil, each of which must be compatible with the other additives and with the components of the base oil. Each additive must be so chosen that it does not, in combination with the other additives and the base oil, result in a significant change in viscosity index from that of the base oil. A change in V.I. greater than about 20 units is regarded as significant for this purpose.

In the following tests, the work was done using a lubricating oil blend containing:

23.5% of a hydrogenated decene oligomer
28.2% of ester A
26.5% of ester B
21.8% by weight of an additive combination of a metal-containing detergent, an alkalinity source, a non-metallic detergent, a friction reducer and an antioxidant.

The blend had the following typical properties:

| | |
|---|---|
| TBN | 12 |
| Appearance | Clear |
| Flash, °F. | 520 |
| Pour, °F. | −60 |
| CCS at 0° F., Poise | 43.5 |
| Viscosity at 100° F. (cSt./SUS) | 106.4/493 |
| at 210° F. (cSt./SUS) | 14.25/75 |
| Viscosity, cSt. at 40° F. | 96.2 |
| cSt. at 100° F. | 13.9 |
| Viscosity Index | 149 |
| SAE Viscosity Grade | 15W–40 |

With respect to the individual oil components of the blend the hydrocarbon oil is a synthetic hydrogenated decene oligomer (mainly the trimer) having the following typical properties:

Pour=<75° F.
Flash=455° F.
Fire=505° F.
KV at 100° F.=31.98
KV at 210° F.=5.77
KV at −65=52,450
KV at −40=7,250

Synthesis of the ester oils

Ester A was made by mixing 668 parts of a mixture containing 55 wt % of a $C_8$ fatty acid and 45% of a $C_{10}$ fatty acid with 169 parts of trimethylolpropane and heating the total mixture until no further water was removed. The ester had a viscosity of 4.5 cST. at 210° F. and a viscosity index of 140. There was obtained the trimethylolpropane ester of mixed octanoic/decanoic acid.

Ester B was made similarly by mixing 355 parts of a $C_7$ fatty acid, 339 parts of a linoleic acid dimer (containing 75% dimer and 25% trimer) and 180 parts of trimethylolpropane and heating the mixture until no further water was removed. The trimethylolpropane ester of mixed heptanoic/linoleic acid dimer acids was obtained.

The blend set forth performs well in a variety of laboratory tests designed to test the ability of a lubricant to resist corrosion and oxidation, among other things. The following disclosure summarizes the results obtained in the tests utilized:

EMD Silver Corrosion Tests

The EMD Silver Corrosion Test is designed to evaluate the anticorrosion properties of lubricating oils towards silver bearings used in EMD diesel engines.

In this test, a copper and a silver strip were immersed for 3 days in the test oil maintained at 285° F. or 325° F. The silver specimens were evaluated for appearances and weight changes at the conclusion of tests. A good oil will give little change in the appearance of the silver and should give less than 1 mg weight loss. The results are shown in Table 2.

TABLE 2

| | Run 72 hours at 285° F. | Run 72 hours at 325° F. |
|---|---|---|
| Silver weight loss, mg | 0.6 | 0.3 |
| Overall Rating | Good | Good |

Other tests were:

B10B Catalytic Oxidation Test

The test is designed to evaluate the antioxidation properties of lubricating oils by measuring the oil viscosity increase due to oxidation at the completion of the test.

The lubricant was evaluated by passing a controlled volume of dry air through a measured sample of oil at elevated temperature in the presence of iron, copper, aluminum, and lead catalysts. After 40 hours at 325° F., the increase in kinematic viscosity at 210° F. was determined, and the increase was only 8%.

CRC L38 Engine Test

The CRC L-38 Test is a single-cylinder gasoline engine test which measures oil oxidation and corrosion. The engine is fitted with copper lead inserts in the connecting rod bearing to permit evaluation of bearing corrosion protection. Operation is at elevated coolant and oil temperatures in order to promote oil oxidation and the formation of oxy-acids that are corrosive to these inserts. Oil performance is judged by the weight loss of the bearing inserts after test completion. The following results were obtained in this test:

TABLE 3

| | |
|---|---|
| Bearing wt loss (50 mg max) | 16 |
| Overall rating | Excellent |

Caterpillar 1-G Test

The Caterpillar 1-G Test (FTM 341.3) is used to evaluate the ability of oils to control ring sticking, wear, and engine deposits in diesel engines operating under high speed, high temperature, highly supercharged conditions. The fuel used has a sulfur content of 0.35 percent minimum. The 1-G is considered to be the most severe of the single-cylinder diesel engine tests, and thus requires the highest detergency for satisfactory performance. Following are the results:

TABLE 4

| Caterpillar 1-G Test (480 Hours - 0.4% Sulfur) | |
|---|---|
| Piston Rating (100 = Clean) | 99 |
| Top Groove Packing, % | 0 |
| WTD (0 = Clean) | 14 |
| Overall Rating | Excellent |

Panel Coking Test

This test is used to evaluate the thermal stability of lubricating oils. Thermal decomposition of the lube oil will cause the formation of a carbanaceous deposit on the panel surface.

In this test, the oil is splashed on a polished aluminum panel maintained at 600° F. The cyclic test is carried out for 24 hours. The test results are reported as weight of carbonaceous deposits on the panel at test completion. The results obtained are shown in Table 5.

TABLE 5

| | Panel Coking Test (24 Hrs., 600° F. Cyclic) | | | | | |
|---|---|---|---|---|---|---|
| | 1 | 2[a] | 3[b] | 4[c] | 5[d] | 6[e] |
| Deposit wt., mg | 23 | 29 | — | 31 | — | 40 |

The following tables summarize some of the data already mentioned hereinabove and presents some data on additional tests. The tables are presented here for the purpose of an easy comparison of data using different lubricants.

TABLE 6

| | B-10-B Oxid. Test (140 Hrs., 325° F.) | | | | | |
|---|---|---|---|---|---|---|
| | 1 | 2[a] | 3[b] | 4[c] | 5[d] | 6[e] |
| 0/0 Viscosity Increase, 210° F. | 12.0 | 22.0 | 37.0 | 24 | 33 | 69 |
| TAN Increase | 5.0 | 1.1 | 1.1 | 0 | 3.4 | 3.4 |
| Lead Loss | 0 | 0 | 0.1 | 0 | 0.1 | 0.2 |
| Sludge | Nil | Nil | Nil | Trace | Nil | Trace |

TABLE 7

| | Caterpillar 1-G Test (0.4% Sulfur Fuel) | | |
|---|---|---|---|
| | 1 | 2[a] | 3[b] |
| At 240 Hrs. | | | |
| WTD (0 = Clean) | 1 | 0.3 | 9 |
| Top Groove Filling, % | 0 | <1 | 5 |
| At 480 Hrs. | | | |
| WTD (0 = Clean) | 14 | 11 | 13 |

TABLE 7-continued

| | Caterpillar 1-G Test (0.4% Sulfur Fuel) | | |
|---|---|---|---|
| | 1 | 2[a] | 3[b] |
| Top Groove Packing, % | 0 | <1 | 5 |

In Tables 5, 6 and 7, letters a–e have the following meanings:
[a]Same blend, except it contains 5% of the non-metallic detergent.
[b]Same as a, except the blend has 20% of the detergent.
[c]Same blend, except it contains 6% of an ashless detergent instead of the previous non-metallic detergent.
[d]Same blend, except it contains 2% of the ashless detergent instead of the previous non-metallic detergent.
[e]Same additive system as listed above with respect to the test blend, but in an SAE 40 Mineral Oil.

When the same additives were used in a mineral oil base, the low temperature performance and the oxidation and thermal stability were less advantageous.

We claim:

1. In an improved lubricating oil composition comprising a major proportion of a lubricating oil and a combination of additives in an amount sufficient to achieve each additives function, the improvement whereby the lubricating oil composition comprises (1) a blend of oils comprising (a) from about 40 to about 60% by weight of said blend of a hydrogenated oligomer of an alpha olefin having from 6 to 12 carbon atoms and (b) from about 60 to about 40% by weight of said blend of a mixture of at least two synthetic ester oils in the proportion of 20 to 30% by weight of either, said ester oils being prepared by reacting a monocarboxylic acid having from 6 to 18 carbon atoms with a polyhydroxy aliphatic hydrocarbon containing 4 to 8 carbon atoms and from 2 to 4 hydroxyls and (2) said combination of additives, which combination does not contain a viscosity index improver.

2. The composition of claim 1 wherein said mixture of ester oils has a kinematic viscosity of from about 3 to about 50 centistokes and a viscosity index of at least 125.

3. The composition of claim 1 wherein said combination of additives constitutes from about 10 to about 30% by weight of the oil blend.

4. The composition of claim 1 wherein one ester is made from (1) a mixture of a $C_8$ fatty acid, a $C_{10}$ fatty acid and (2) trimethylolpropane.

5. The composition of claim 1 wherein one ester is made from (1) a mixture of a $C_7$ fatty acid and linoleic acid dimer and (2) trimethylolpropane.

6. The composition of claim 4 wherein the $C_8$ and $C_{10}$ acids are present in said mixture in the proportions of 55 and 45%, by weight, respectively.

7. The composition of claim 5 wherein the $C_7$ and linoleic acids are present in said mixture in the proportions of 51 and 49% by weight, respectively.

8. The composition of claim 1 wherein said mixture comprises 28% of a $C_8$ to $C_{10}$ acid-trimethylolpropane ester and 27% of a $C_7$ acid-linoleic acid-trimethylolpropane ester, both by weight.

9. The composition of claim 1 wherein the hydrogenated oligomer is a hydrogenated decene oligomer.

10. The composition of claim 9 wherein the oligomer is the decene trimer.

11. The composition of claim 1 consisting essentially of:

(a) 23.5% by weight of a hydrogenated decene trimer;
(b) 28.2% by weight of a $C_8$ acid-$C_{10}$ acid-trimethylolpropane ester;
(c) 26.5% by weight of a $C_7$ acid-linoleic acid-trimethylolpropane ester;
(d) 21.8% by weight of an additive combination of metal-containing detergent, an alkalinity source, a non-metallic detergent, a friction reducer and an antioxidant.

* * * * *

UNITED STATES PATENT AND TRADEMARK OFFICE

CERTIFICATE OF CORRECTION

PATENT NO. : 4,175,046

DATED : November 20, 1979

INVENTOR(S) : Pierre M. Coant and George W. Munns, Jr.

It is certified that error appears in the above-identified patent and that said Letters Patent is hereby corrected as shown below:

Column 1, after the title "SYNTHETIC LUBRICANT" insert

--REFERENCE TO COPENDING APPLICATIONS

This application is a continuation-in-part of Serial No. 858,986, filed December 9, 1977, now abandoned.--

Signed and Sealed this

*Fourth* Day of *February 1986*

[SEAL]

*Attest:*

DONALD J. QUIGG

*Attesting Officer*

*Commissioner of Patents and Trademarks*